United States Patent [19]

Davis et al.

[11] 4,070,268

[45] Jan. 24, 1978

[54] SOLVENT RECOVERY IN A COAL DEASHING PROCESS

[75] Inventors: Robert E. Davis, Oklahoma City; Roger A. Baldwin, Warr Acres, both of Okla.

[73] Assignee: Kerr-McGee Corporation, Oklahoma City, Okla.

[21] Appl. No.: 691,579

[22] Filed: June 1, 1976

[51] Int. Cl.[2] ..... C10G 1/04

[52] U.S. Cl. ..... 208/8

[58] Field of Search ..... 208/8

[56] References Cited

U.S. PATENT DOCUMENTS

| | | | |
|---|---|---|---|
| 3,607,717 | 9/1971 | Roach | 208/8 |
| 3,852,183 | 12/1974 | Snell | 208/8 |
| 3,954,595 | 5/1976 | Sze et al. | 208/8 |
| 3,974,073 | 8/1976 | Sze et al. | 208/8 |

*Primary Examiner*—Herbert Levine
*Assistant Examiner*—James W. Hellwege
*Attorney, Agent, or Firm*—William G. Addison

[57] ABSTRACT

An improved coal deashing process wherein coal is mixed with a first dissolving solvent, heated, solubilized and flashed to provide a prepared mixture. The flashing is effected at a temperature below about 650° F. to increase the amount of the first dissolving solvent in the prepared mixture. The prepared mixture then is mixed with a second dissolving solvent to produce a feed mixture which is subjected to two or more successive phase separations. Insoluble coal products present are separated from the feed mixture in a first separation zone and the soluble coal products are recovered from the first and the second dissolving solvents in a second separation zone. The second dissolving solvent is recovered from the first and the second heavy fractions and the second light fraction for recycling to aid in producing the feed mixture. The first dissolving solvent is recovered from the first and second flash zones. This results in an enhanced recovery of the first dissolving solvent for recycle for utilization in the initial solubilization of the coal.

8 Claims, 1 Drawing Figure

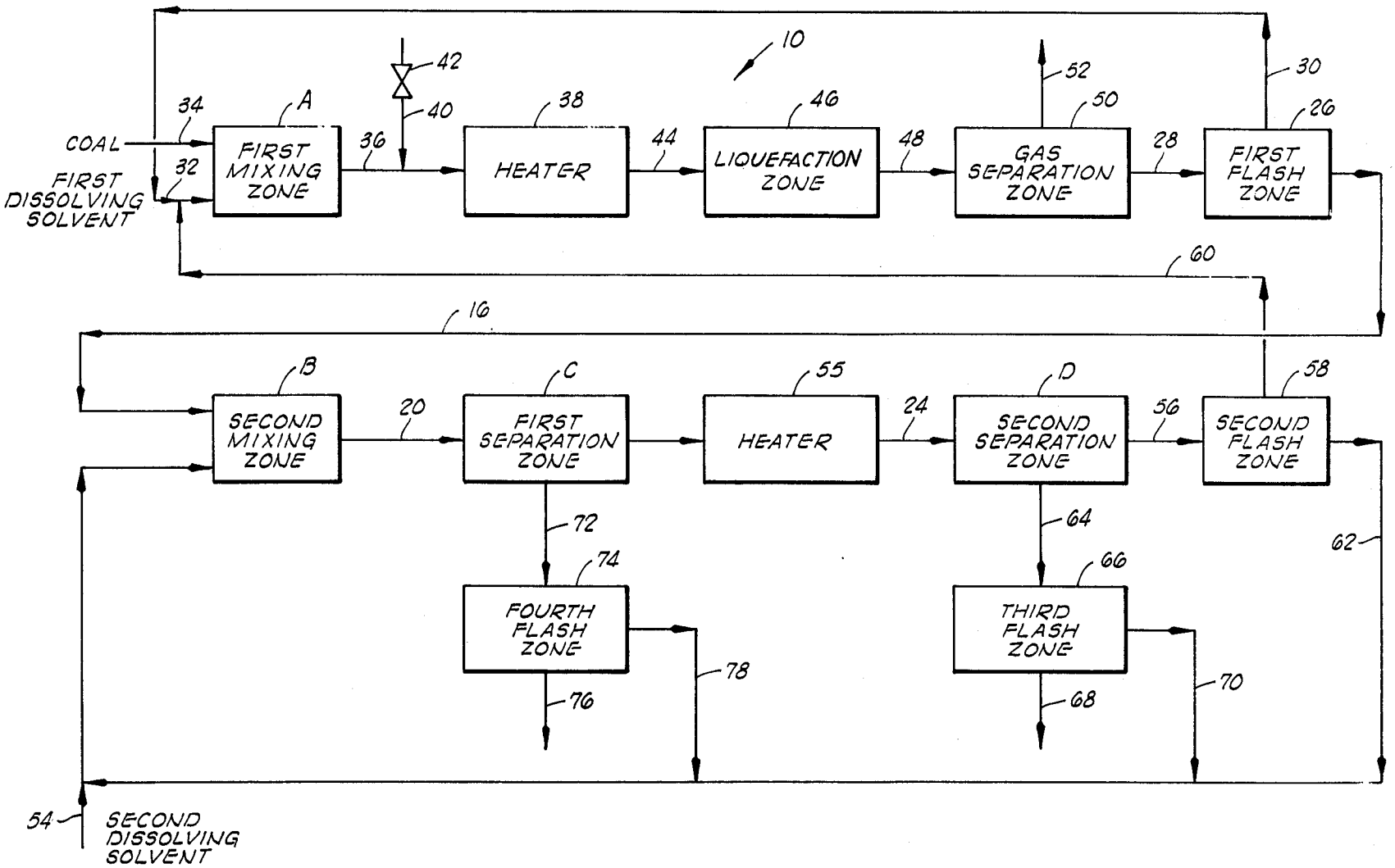
FIRST FLASH ZONE
GAS SEPARATION ZONE
LIQUEFACTION ZONE
HEATER
FIRST MIXING ZONE
SECOND FLASH ZONE
SECOND SEPARATION ZONE
HEATER
FIRST SEPARATION ZONE
SECOND MIXING ZONE
THIRD FLASH ZONE
FOURTH FLASH ZONE
COAL
FIRST DISSOLVING SOLVENT
SECOND DISSOLVING SOLVENT
10
16
A
B
C
D
26
28
30
32
34
36
38
40
42
44
46
48
50
52
54
55
56
58
60
62
64
66
68
70
72
74
76
78
20
24

SOLVENT RECOVERY IN A COAL DEASHING PROCESS

CROSS REFERENCE TO RELATED APPLICATIONS

Aspects of the present invention are related to subject matter disclosed in a co-pending application entitled "A COAL DEASHING PROCESS HAVING IMPROVED SOLVENT RECOVERY TECHNIQUES", Ser. No. 691,575, filed on an even date herewith and assigned to the same assignee as the present invention.

BACKGROUND OF THE INVENTION

1. Field of the Invention

The present invention relates generally to coal deashing processes and, more particularly, but not by way of limitation. to improved solvent recovery systems in coal deashing processes.

2. Description of the Prior Art

Various coal deashing processes have been developed in the past wherein coal has been treated with one or more solvents and processed to separate the resulting insoluble coal products from the soluble coal products, some systems including provisions for recovering and recycling the solvents.

U.S. Pat. Nos. 3,607,716 and 3,607,717, issued to Roach and assigned to the same assignee as the present invention, disclose processes wherein coal liquefaction products are contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal product is separated into multiple fractions. Other processes for separating the soluble coal products from the insoluble coal products utilizing one or more solvents are disclosed in U.S. Pat. Nos. 3,607,718 and 3,642,608, both issued to Roach et al., and assigned to the same assignee as the present invention.

BRIEF DESCRIPTION OF THE DRAWING

The single FIGURE diagrammatically and schematically shows a coal deashing system arranged in accordance with the present invention.

DESCRIPTION OF THE PREFERRED EMBODIMENTS

Referring now to the drawing, general reference numeral 10 designates a coal deashing system arranged in accordance with the present invention; reference letters indicate the principal process steps of the invention.

In general, coal to be processed in accordance with the present invention is contacted and mixed with a first dissolving solvent in a first mixing zone A and processed as illustrated to provide a prepared mixture which is passed into a second mixing zone B. In the second mixing zone B, the prepared mixture is mixed with a second dissolving solvent to provide a feed mixture which is passed to a first separation zone C wherein the feed mixture is separated into a first heavy fraction and a first light fraction. The first light fraction is passed into a second separation zone D wherein it is separated into a second light fraction and a second heavy fraction.

In accordance with the present invention, the second light fraction is treated to separate the first and second dissolving solvents; the first dissolving solvent being recycled to the first mixing zone A and the second dissolving solvent being recycled to the second mixing zone B.

The recovery and re-utilization of the first and the second dissolving solvents reduces the amounts of make-up first and second dissolving solvents which must be added to the coal liquefaction products deashing process, thereby reducing the cost of processing the coal and providing a process which is more economical in operation.

The process of the present invention also includes a first flash zone 26. A mixture including soluble coal products, insoluble coal products and first dissolving solvent is passed into the first flash zone 26 wherein the mixture is flashed producing (1) a stream comprising the prepared mixture which is passed into second mixing zone B and (2) an overhead stream containing volatile coal conversion products and most of the first dissolving solent which is recycled to first mixing zone A.

In typical prior art coal deashing systems, the temperature level in the first flash zone 26 has been increased in an effort to increase the amounts of the first dissolving solvent recovered from the first flash zone 26. In accordance with the present invention, the temperature level in the first flash zone 26 is lowered to increase the amount of the first dissolving solvent present in the prepared mixture leaving the first flash zone 26. In this fashion, the total amount of the first dissolving solvent subsequently recoverable in the second flash zone for recycling to the first mixing zone A is increased. The operating conditions (the temperature and pressure levels) in the first flash zone 26 are less severe which results in reduced maintenance and operation problems. Further, the enhanced recovery of the first dissolving solvent results in a decreased consumption of hydrogen in the liquefaction zone 46. It is well known that in coal conversion processes such as those designated as solvent refined coal processes that significant quantities of hydrogen are required to maintain the required inventory of the first dissolving solvent.

The term "insoluble coal products" as used herein refers to the undissolved coal, ash, other solid inorganic particulte matter and other such matter which is insoluble in the dissolving solvent. The insoluble inorganic material in coal which is sometimes assumed to be about equal to the ash remaining after igniting the coal under controlled conditions is sometimes referred to in the art as "mineral matter". With respect to coal and related minerals, typical mineral matter components include kaolinite, calcite, gypsum and pyrite. In thermally or hydrogenated treated materials, pyrite is present as pyrrhotite. Mineral mineral analyses are reported frequently as oxide contents, that is, $SiO_2$, $Al_2O_3$, CaO and the like.

The term "soluble coal products" as used herein refers to the constituents in the feed mixture which is soluble in the second dissolving solvent.

Referring to the coal deashing process 10 of the present invention as depicted in the drawing, the first dissolving solvent is passed from a first solvent surge vessel or the like (not shown) through a conduit 32 into the first mixing zone A.

Pulverized coal contained in a coal storage or the like (not shown) is passed into the first mixing zone A through a conduit 34 at a rate controlled by a solids feeder or the like (not shown) interposed in the conduit 34. The feed rates of the first dissolving solvent and the pulverized coal preferrably are controlled to maintain the weight ratio of the first dissolving solvent to coal in the first mixing zone A within a range from about one-to-one to about 20-to-one. More particularly, it has been found desirable to maintain the weight ratio of first dissolving solvent to coal in the first mixing zone A in a range from about two-to-one to about five-to-one; and best results have been obtained when the weight ratio was maintand at about three-to-one.

In the first mixing zone A, the coal and the first dissolving solvent are agitated or mixed with a stirring mechanism (not shown) at about ambient temperature and pressure to form a slurry. That slurry is withdrawn from the first mixing zone A through a conduit 36 and passed to a heater 38 where the slurry is heated. In one preferred embodiment, gaseous hydrogen is passed from a source (not shown) through a conduit 40 connected to the conduit 36, the gaseous hydrogen being mixed with the slurry flowing through the conduit 36 and the resulting mixture being heated via the heater 38. A valve 42 is interposed in the conduit 40 for controlling the flow of the gaseous hydrogen to be mixed with the slurry flowing through the conduit 36.

The slurry, which may incude the gaseous hydrogen, is discharged from the heater 38 at a temperature of about 800° F. and passed through a conduit 44 into a liquefaction zone 46 to effect solubilization of about ninety percent of the moisture and ash-free coal values. In one embodiment, the pressure level in liquefaction zone 46 is greater than about 1200 psig and preferably in the range of about 1200 psig to about 2000 psig.

In the liquefaction zone 46, the first dissolving solvent is contacted with the coal at the elevated liquefaction temperature and pressure for a period of time sufficient to solubilize the soluble constituents of the coal and produce a mixture of coal liquefaction products (the soluble coal products), the dissolving solvent and the insoluble coal products. The insoluble coal products consist largely of the ash mineral fraction of the coal and some hydrocarbonaceous material.

The mixture of soluble coal products, insoluble coal products, first dissolving solvent and gases is withdrawn from the liquefaction zone 46 and passed through a conduit 48 into a gas separation zone 50, which includes a degassing vessel or the like, wherein the mixture is degassed by permitting the excess hydrogen, other gases and vapors to be discharged through a conduit 52. In some operational embodiments, the hydrogen-containing gases are discharged through the conduit 52 and passed to a hydrogen recycle system (not shown) for re-use in the process. In one embodiment, the temperature level of the mixture in the gas separation zone 50 is about 800° F. and the pressure level is in the range of from about 1200 psig to about 1500 psig.

The degassed mixture is discharged from the gas separation zone 50 and passed through the conduit 28 into the first flash zone 26, which includes a flash vessel or the like (not shown). In the operational embodiment referred to before, the pressure level in the first flash zone 26 is less than about 20 psig. In the first flash zone 26 a major portion of first dissolving solvent is flashed off and discharged from the first flash zone 26 through the conduit 30 for recycle to the first mixing zone A. As mentioned before, the temperature level in the first flash zone 26 is lowered to below about 650° F. to maintain the desired quantity of first dissolving solvent in the prepared mixture discharged from the first flash zone 26 through the conduit 16.

The mixture consisting essentially of the soluble coal products, the insoluble coal products and a portion of the first dissolving solvent (referred to herein as the "prepared mixture"), is passed from the first flash zone 26 through the conduit 16 into the second mixing zone B and the second dissolving solvent is passed into the second mixing zone B via a conduit 54. The second dissolving solvent may be contained in a second solvent surge vessel or the like (not shown). In the second mixing zone B, the mixture discharged from the first zone E is contacted by and mixed with the second dissolving solvent and the resulting mixture is discharged from the second mixing zone B into and through the conduit 20, such resulting mixture being referred to herein as the "feed mixture."

The embodiment shown in the drawing contemplates the utilization of two, different dissolving solvents, one of the dissolving solvents being introduced into the first mixing zone A and referred to herein as the "first dissolving solvent", and one other dissolving solvent being introduced into the second mixing zone B and sometimes referred to herein as the "second dissolving solvent." In the embodiment of the present invention shown in the drawing, the first dissolving solvent preferably is a coal derived recycle solvent or alternatively an organic solvent suitable for liquefying coal in the manner herein described. Various solvents suitable for use as the first dissolving solvent are described in detail in U.S. Pat. Nos. 3,607,716, 3,607,717, 3,607,718 and 3,642,608, the disclosures of which are incorporated herein by reference. The second dissolving solvent is of the type sometimes described as a "light organic solvent" in the just-mentioned patents and include, for example, pyridine, benzene and toluene.

The feed mixture is introduced into a first separation zone C wherein it is subjected to a temperature in the range of from about 460° F. to about 620° F. and a pressure in the range of from about 650 psig to about 1000 psig whereupon it separates into a first light fraction and a first heavy fraction.

The first light fraction comprises the soluble coal products, substantially all of the first dissolving solvent and most of the second dissolving solvent. That fraction is withdrawn from the first separation zone C and passed through a heater 55 and the conduit 24 into the second separation zone D. In heater 55, the first light fraction is heated to a temperature within the range of from about 630° F. to about 900° F. and is maintained at a pressure in the range of from about 650 psig to about 1000 psig whereupon, in the second separation zone D, the first fraction is separated into (1) a second light fraction comprising the first dissolving solvent and most of the second dissolving solvent and (2) a second heavy fraction comprising the soluble coal products and the second dissolving solvent in about a one-to-one weight ratio. The second light fraction is withdrawn from the second separation zone B and passed through a conduit 56 into a second flash zone 58. The pressure level on the second light fraction is reduced to about 0 psig to about 50 psig in the second flash zone 58, to flash off a stream comprising the first dissolving solvent and another stream comprising the second dissolving solvent.

The first dissolving solvent is withdrawn from the second flash zone 58 and passed through a conduit 60 which is connected to the conduit 32. Thus, the first dissolving solvent is separated from the second dissolving solvent in the second flash zone 58 and the first dissolving solvent is recovered and recycled into the first mixing zone A via the conduits 60 and 32 for mixing with the coal to aid in the dissolution of the raw feed coal.

The second dissolving solvent is withdrawn from the second flash zone 58 and passed through a conduit 62 which is connected to the conduit 54. In this manner, the second dissolving solvent is recovered from the second light fraction and recycled into the second mixing zone B for mixing with the prepared mixture to aid in providing the feed mixture in a manner described before. This recycled second dissolving solvent may contain up to 10 percent by weight of the first dissolving solvent. Preferably, this recycled second dissolving solvent will contain less than 2 to 3 weight percent first dissolving solvent.

The second heavy fraction is withdrawn from the second separation zone D and passed through a conduit 64 into a third flash zone 66 where the pressure is reduced to a level in the range of from about 0 psig to about 50 psig. In this manner, the second heavy fraction is flashed in the third flash zone 66 to produce one stream comprising the second dissolving solvent and some of the first dissolving solvent and another stream comprising the soluble coal products. The soluble coal products are withdrawn from the third flash zone 66 through a conduit 68. These soluble coal products comprise deashed coal (less than 0.16% ash) of low sulfur content making it ecologically suitable for use as a fuel in combination processes. The flashed second dissolving solvent is withdrawn from the third flash zone 66 and passed through a conduit 70 and conduits 62 and 54 into the second mixing zone B for mixing with the prepared mixture to aid in providing the feed mixture.

The first heavy fraction is withdrawn from the first separation zone C through a conduit 72 and passed into a fourth flash zone 74 where the pressure is reduced to a level in the range of from about 0 psig to about 50 psig, In this manner, the first heavy fraction is flashed in the fourth flash zone 74 to produce one stream comprising the second dissolving solvent and another stream comprising the insoluble coal products. The insoluble coal products are withdrawn from the fourth flash 74 through a conduit 76 for subsequent utilization, perhaps in a gasification plant. The second dissolving solvent is withdrawn from the fourth flash zone 74 and passed through a conduit 78 and conduits 62 and 54 into the second mixing zone B for mixing with the prepared mixture to aid in producing the feed mixture.

In accordance with the present invention, the first dissolving solvent is recovered principally from the first flash zone as well as from the second flash zone. The second dissolving solvent is recovered from both the first and the second heavy fractions and from the second light fraction whereby both solvents are recycled to the first and second mixing zones, respectively. The recovery and recycling of the first and the second dissolving solvents reduces the amounts of make-up first and second dissolving solvents which must be added to the coal deashing process, thereby reducing the operating cost and providing a more economical coal deashing system. Further, the enhanced recovery of the first dissolving solvent results in a reduction in the consumption of hydrogen required in the coal dissolution step. That is, since the hydrogenated first dissolving solvent has been recovered for re-use, less fresh first dissolving solvent is needed, therefore less hydrogen is needed. Yet another advantage of this process is that it produces a deashed coal product which meets today's ecological requirements. The combination of beneficial aspects of the above described deashing process results in a superior overall process.

Changes may be made in the process apparatus or in the steps of the process or in the sequence of the steps of the process of the present invention without departing from the spirit and scope of the invention as defined in the following claims.

What is claimed is:

1. A process comprising:

mixing in a first mixing zone a first dissolving solvent with coal;

solubilizing the coal at elevated temperatures and pressures and flashing the mixture comprising the first dissolving solvent, the soluble coal products and the insoluble coal products to provide a prepared mixture;

mixing in a second mixing zone the prepared mixture with a second dissolving solvent to provide a feed mixture;

introducing the feed mixture into a first separation zone;

maintaining the temperature level in the first separation zone in the range of from about 460° F. to about 620° F., and maintaining the pressure level in the first separation zone in the range of from about 650 psig to about 1000 psig;

separating the feed mixture in the first separation zone into a first heavy fraction and a first light fraction comprising the soluble coal products, some of the first dissolving solvent and some of the second dissolving solvent;

withdrawing the first light fraction from the first separation zone;

heating the first light fraction;

introducing the first light fraction into a second separation zone;

maintaining the temperature level in the second separation zone in the range of from about 630° F. to about 900° F., and maintaining the pressure level in the second separation zone in the range of from about 650 psig to about 1000 psig;

separating the first light fraction in the second separation zone into a second light fraction comprising some of the second dissolving solvent and some of the first dissolving solvent, and a second heavy fraction;

withdrawing the second fraction from the second separation zone;

flashing the second light fraction to produce one stream comprising the first dissolving solvent and one other stream comprising the second dissolving solvent;

passing the second dissolving solvent separated from the second light fraction to the second mixing zone for mixing with the prepared mixture to aid in providing the feed mixture; and passing the first dissolving solvent separated from the second light fraction to the first mixing zone for mixing with the coal to aid in providing the prepared mixture.

2. The process of claim 1 defined further to include the steps of:

withdrawing the first heavy fraction from the first separation zone;

flashing the first heavy fraction to produce one stream comprising the second dissolving solvent and one other stream comprising most of the insoluble coal products; and passing the second dissolving solvent separated from the first heavy fraction to the second mixing zone for mixing with the prepared mixture to form the feed mixture.

3. The process of claim 1 defined further to include the steps of:

withdrawing the second heavy fraction from the second separation zone;

flashing the second heavy fraction to produce one stream comprising the second dissolving solvent and one other stream comprising most of the soluble coal products; and passing the second dissolving solvent separated from the second heavy fraction to the second mixing zone for mixing with the prepared mixture to form the feed mixture.

4. The process of claim 1 defined further to include the steps of:

withdrawing the first heavy fraction from the first separation zone;

flashing the first heavy fraction to produce one stream comprising the second dissolving solvent and one other stream comprising most of the insoluble coal products;

passing the second dissolving solvent separated from the first heavy fraction to the second mixing zone for mixing with the prepared mixture to form the feed mixture;

withdrawing the second heavy fraction from the second separation zone;

flashing the second heavy fraction to produce one stream comprising the second dissolving solvent and one other stream comprising most of the soluble coal products containing less than 0.16% ash; and passing the second dissolving solvent separated from the second heavy fraction to the second mixing zone for mixing with the prepared mixture to form the feed mixture.

5. The process of claim 1 wherein the mixture of coal and a first dissolving solvent is solubilized and flashed defined further the steps of:

liquefying the mixture of coal and the first dissolving solvent in a liquefaction zone by heating the mixture to a temperature of about 800° F. and maintaining the pressure level in the range of from about 1200 psig to about 2000 psig to substantially solubilize the coal;

withdrawing the mixture from the liquefaction zone;

flashing the mixture withdrawn from the liquefaction zone in a first flash zone to produce at least one stream of a prepared mixture comprising some of the first dissolving solvent, the insoluble coal products and the soluble coal products; and maintaining the temperature level in the first flash zone at a predetermined temperature level to maintain the desired amount of the first dissolving solvent remaining in the prepared mixture after flashing the mixture withdrawn from the liquefaction zone.

6. The process of claim 1 wherein the step of solubilizing and flashing the mixture to provide the prepared mixture is defined further to include the steps of:

heating the mixture of coal and the first dissolving solvent withdrawn from the first mixing zone;

adding gaseous hydrogen to the mixture of coal and first dissolving solvent;

liquefying the mixture of coal, gaseous hydrogen and the first dissolving solvent in a liquefaction zone by heating the mixture to a temperature of about 800° F. and maintaining the present level in the range of from about 1200 psig to about 2000 psig to solubilize the coal so as to produce a mixture comprising the soluble coal products, the insoluble coal products, the first dissolving solvent and the gaseous hydrogen;

withdrawing the mixture from the liquefaction zone;

introducing the mixture withdrawn from the liquefaction zone into a gas separation zone;

separating gaseous hydrogen from the mixture withdrawn from the liquefaction zone in the gas separation zone; and flashing the degassed mixture in a first flash zone to produce at least one stream comprising the prepared mixture.

7. The process of claim 6 defined further to include the step of:

maintaining the temperature level in the first flash zone at a prdetermined temperature level to maintain the desired amount of the first dissolving solvent remaining in the prepared mixture after flashing the mixture withdrawn from the liquefaction zone.

8. The process of claim 7 wherein the step of maintaining the temperature level in the first flash zone is defined further to include the step of:

maintaining the temperature level in the first flash zone below about 650° F.

* * * * *

UNITED STATES PATENT OFFICE

CERTIFICATE OF CORRECTION

PATENT NO. : 4070268

DATED : January 24, 1978

INVENTOR(S) : Robert E. Davis and Roger A. Baldwin

It is certified that error appears in the above-identified patent and that said Letters Patent are hereby corrected as shown below:

Column 4, line 13, after "first" insert -- flash --

Column 5, line 45, after "flash" insert -- zone --

Column 6, line 51, after first "second" insert -- light --

Column 8, line 24, "present" should read -- pressure --

Signed and Sealed this

Sixteenth Day of May 1978

[SEAL]

Attest:

RUTH C. MASON
Attesting Officer

LUTRELLE F. PARKER
Acting Commissioner of Patents and Trademarks